US011780539B2

(12) United States Patent
Lin et al.

(10) Patent No.: US 11,780,539 B2
(45) Date of Patent: Oct. 10, 2023

(54) STERN RUDDER FIXING STRUCTURE, STERN RUDDER AND PADDLE BOARD

(71) Applicant: WEIHAI BOAT OUTDOOR CO., LTD, Weihai (CN)

(72) Inventors: Peng Lin, Weihai (SD); Leqiang Lin, Weihai (CN); Yongjiang Shi, Weihai (CN)

( * ) Notice: Subject to any disclaimer, the term of this patent is extended or adjusted under 35 U.S.C. 154(b) by 217 days.

(21) Appl. No.: 17/382,345

(22) Filed: Jul. 22, 2021

(65) Prior Publication Data

US 2022/0144388 A1 May 12, 2022

(30) Foreign Application Priority Data

Nov. 6, 2020 (CN) ..... 202022547554.7

(51) Int. Cl.
*B63B 32/66* (2020.01)

(52) U.S. Cl.
CPC ..... *B63B 32/66* (2020.02)

(58) Field of Classification Search
CPC ..... B63B 32/60; B63B 32/62; B63B 32/64; B63B 32/66
See application file for complete search history.

(56) References Cited

U.S. PATENT DOCUMENTS 4,850,917 A * 7/1989 Wilson ..... B63B 32/66 114/140
4,924,791 A * 5/1990 Scholle ..... B63B 32/64 114/363
5,934,963 A * 8/1999 Frizzell ..... B63B 32/66 441/79

* cited by examiner

*Primary Examiner* — Andrew Polay

(57) ABSTRACT

A stern rudder fixing structure for fixedly connecting a stern rudder body to a stern rudder base is disclosed. The stern rudder fixing structure comprises a T-shaped bolt, a nut and a rotary rod, wherein the stern rudder body is detachably connected to the stern rudder base. The stern rudder comprises a stern rudder body, a stern rudder base and a fixing structure. The stern rudder and a paddle board provided by the disclosure are matched with a first insertion hole and a second insertion hole of the stern rudder base through the fixing structure, so that the stern rudder body and the stern rudder base are quickly assembled and dissembled in a time-saving and error-saving mode.

10 Claims, 8 Drawing Sheets

STERN RUDDER FIXING STRUCTURE, STERN RUDDER AND PADDLE BOARD

CROSS-REFERENCE TO RELATED APPLICATIONS

The application claims priority to Chinese patent application No. 202022547554.7, filed on Nov. 6, 2020, the entire contents of which are incorporated herein by reference.

TECHNICAL FIELD

The present disclosure belongs to the technical field of cutting tools, and particularly relates to a cutting device of a self-centering cutter holder.

BACKGROUND

A stern rudder, which is similar to fins of fish, in a paddle board is mounted on a tail position of the paddle board, thereby achieving the effect of stabilizing a direction during surfing on sea. In the prior art, the stern rudder body is mounted on a stern rudder base; in the mounting process, a tapping cushion block for fixing the stern rudder body needs to put into the stern rudder base in advance, is liable to tilt, and needs to pull out to put again, so that much time is needed for aligning a hole in the stern rudder base to the cushion block to fix the stern rudder with a bolt. As a result, the mounting is complex, and wastes time and effort. In addition, parts for fixing the stern rudder body are easily loosened and easily dropped and lost, and the cushion block inside is easy to lose during later-stage replacement or maintenance.

SUMMARY

The objective of the disclosure is to provide a stern rudder and a paddle board using same to overcome the defects in the prior art.

To achieve the objective, the disclosure adopts the following technical solution:

The disclosure discloses a stern rudder fixing structure, which is configured to fixedly connect a stern rudder body to a stern rudder base, including a T-shaped bolt, a nut and a rotary rod for driving the T-shaped bolt to rotate, where the stern rudder body is detachably connected to the stern rudder base; a head of the T-shaped bolt faces downwards and tightly clings to the stern rudder; a rod part of the T-shaped bolt penetrates through a through hole in the stern rudder body from bottom to top and then is in threaded connection to the nut.

As one of the preferred embodiments, the rod part of the T-shaped bolt is cut into two opposite planes which are connected to a threaded part of the rod body; a waist-shaped hole matched with the rod part is formed in the rotary rod; and the rod part of the T-shaped bolt is inserted into the waist-shaped hole of the rotary rod.

As one of the preferred embodiments, a stop block or a stop pin is arranged at one end, away from the waist-shaped hole, of the rotary rod; and the stop block or the stop pin is blocked into a slot or a hole of the stern rudder base when the rotary rod drives the T-shaped bolt to rotate to a set angle.

The disclosure discloses a stern rudder, including a stern rudder body and a stern rudder base, where a first insertion hole and a second insertion hole are sequentially formed in the stern rudder base from top to bottom; the first insertion hole communicates with the second insertion hole; the first insertion hole and the second insertion hole integrally form an inverted-step-shaped hole; one end of the stern rudder base is outwards extended with a mounting burgled part; the stern rudder body is inserted into the first insertion hole and the second insertion hole; the mounting bulge part is positioned in the first insertion hole; the stern rudder base is fixedly arranged in the stern rudder base through the fixing structure;

the fixing structure includes a T-shaped bolt, a nut and a rotary rod for driving the T-shaped bolt to rotate, where a length of the head of the T-shaped bolt is greater than a width of the first insertion hole, a width of the head of the T-shaped bolt is smaller than a width of the first insertion hole, the rotary rod is positioned above the mounting bulge part; when the head of the T-shaped bolt rotates until a length direction thereof is parallel to a length direction of the first insertion hole, the T-shaped bolt can enter the second insertion hole from the first insertion hole in a head-down mode; when the stern rudder body is fixedly connected to the stern rudder base through the fixing structure, the head of the T-shaped bolt is positioned in the second insertion hole, and the length direction of the head of the T-shaped bolt is perpendicular to the length direction of the first insertion hole; and the rod part of the T-shaped bolt passes through the mounting burgled part from bottom to top and is connected to the rotary rod so as to be in a threaded connection state with the nut.

As one of the preferred embodiments, the rod part of the T-shaped bolt is cut into two opposite planes which are connected to a threaded part of the rod body; a waist-shaped hole matched with the rod part is formed in the rotary rod; and the rod part of the T-shaped bolt is inserted into the waist-shaped hole of the rotary rod.

Further preferably, a stop pin is arranged at one end, away from the waist-shaped hole, of the rotary rod; when the stern rudder body is in a locking state, the axis of the stop pin is perpendicular to the length direction of the first insertion hole; and the two end parts of the stop pin are locally blocked into the first insertion hole.

As one of the preferred embodiments, an opening which is wider than the first insertion hole and narrower than or as wide as the first insertion hole is formed in a middle area of the first insertion hole; the opening communicates with the second insertion hole; a limiting column is fixedly arranged on each of two side surfaces at one end, away from the mounting burgled part, of the stern rudder body separately; and when the stern rudder body is inserted into the stern rudder base, the limiting columns slide into the second insertion hole from the opening.

As one of the preferred embodiments, the stern rudder further includes a bottom sealing cover which is used for sealing the bottom of the second insertion hole, wherein an insertion slot is formed in the bottom sealing cover; and the bottom of the stern rudder is inserted into the insertion slot matched with the stern rudder.

As one of the preferred embodiments, the stern rudder base includes a base plate, and a burgled part upwards bulged from the upper surface of the base plate; and the first insertion hole is formed in the burgled part, and the second insertion hole is formed in the burgled part and the base plate.

The disclosure further discloses a paddle board, including the stern rudder and the paddle board body, wherein the stern rudder base is fixedly arranged on the paddle board body.

As one of the preferred embodiments, the bottom end surface of the stern rudder base is adhered onto the paddle board body through an adhesive.

Compared with the prior art, the disclosure has the following advantages:

1) The stern rudder and a paddle board provided by the disclosure are matched with a first insertion hole and a second insertion hole of the stern rudder base through the fixing structure (the T-shaped bolt, the nut and the rotary rod), so that the stern rudder body and the stern rudder base are quickly assembled and dissembled in a time-saving and error-saving mode.

2) The fixing structure for the stern rudder and the paddle board provided by the disclosure includes a T-shaped bolt, a nut and a rotary rod, where the nut is positioned outside the stern rudder base; and the nut can be timely screwed up after the fixing structure is loosened, and parts are not liable o lose.

3) The fixing structure provided by the disclosure includes a rotary rod; when the rotary rod drives the T-shaped bolt to rotate until a length direction of the head of the T-shaped bolt is parallel to a length direction of the first insertion hole, the stern rudder body with the fixing structure is inserted into the first insertion hole and the second insertion hole; after the stern rudder body is inserted into the first insertion hole and the second insertion hole, the locking of the fixing structure is realized by screwing up the nut when the rotary rod rotates to drive the T-shaped bolt to rotate until the length direction of the head of the T-shaped bolt is perpendicular to the length direction of the first insertion hole. And therefore, through the rotary rod, assembly is more convenient and quicker.

BRIEF DESCRIPTION OF DRAWINGS

In order to illustrate the technical solution of the disclosure clearer, the drawings to be used in the description of the embodiments will be described simply below.

DETAILED DESCRIPTION OF THE EMBODIMENTS

The technical solutions in the embodiments of the disclosure will be described clearly and completely in combination with the drawings in the embodiments of the disclosure.

Figure 1:
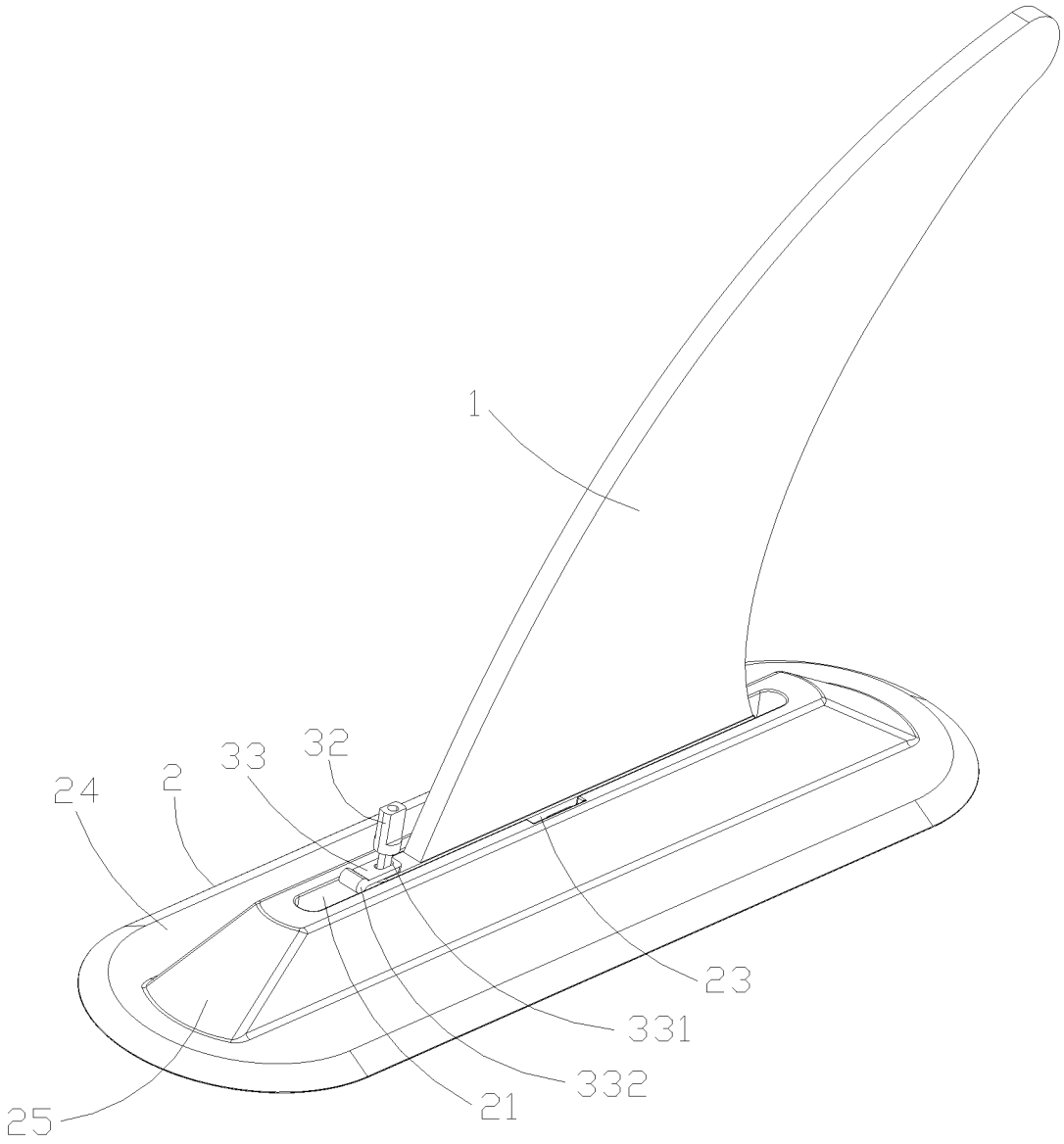
FIG. 1 is a structural schematic diagram of a stern rudder disclosed in embodiments of the disclosure.
Figure 2:
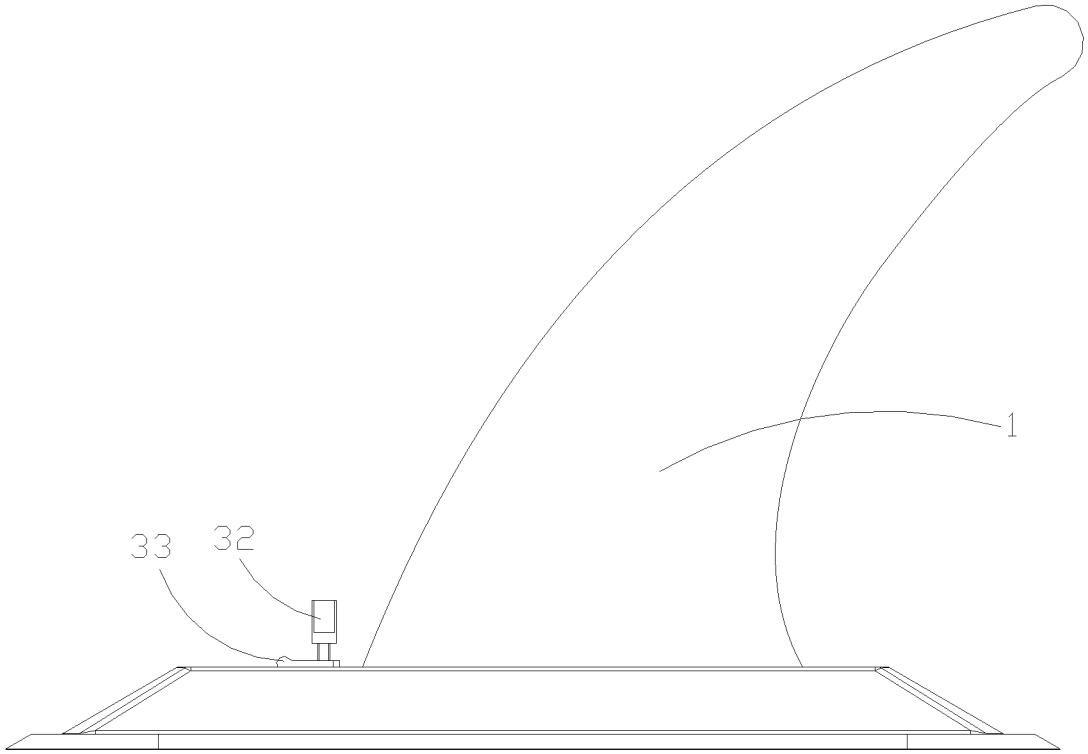
FIG. 2 is a main view of a stern rudder disclosed in embodiments of the disclosure.
Figure 4:
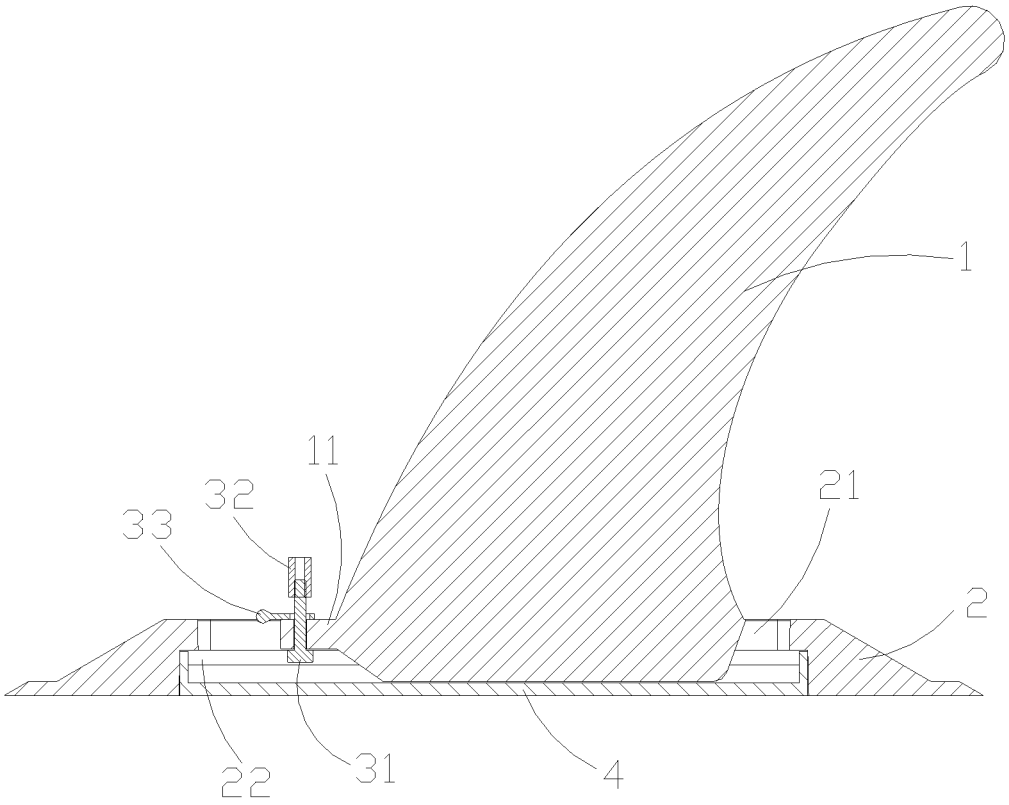
FIG. 4 is a sectional view in a A-A direction of FIG. 3.
Figure 5:
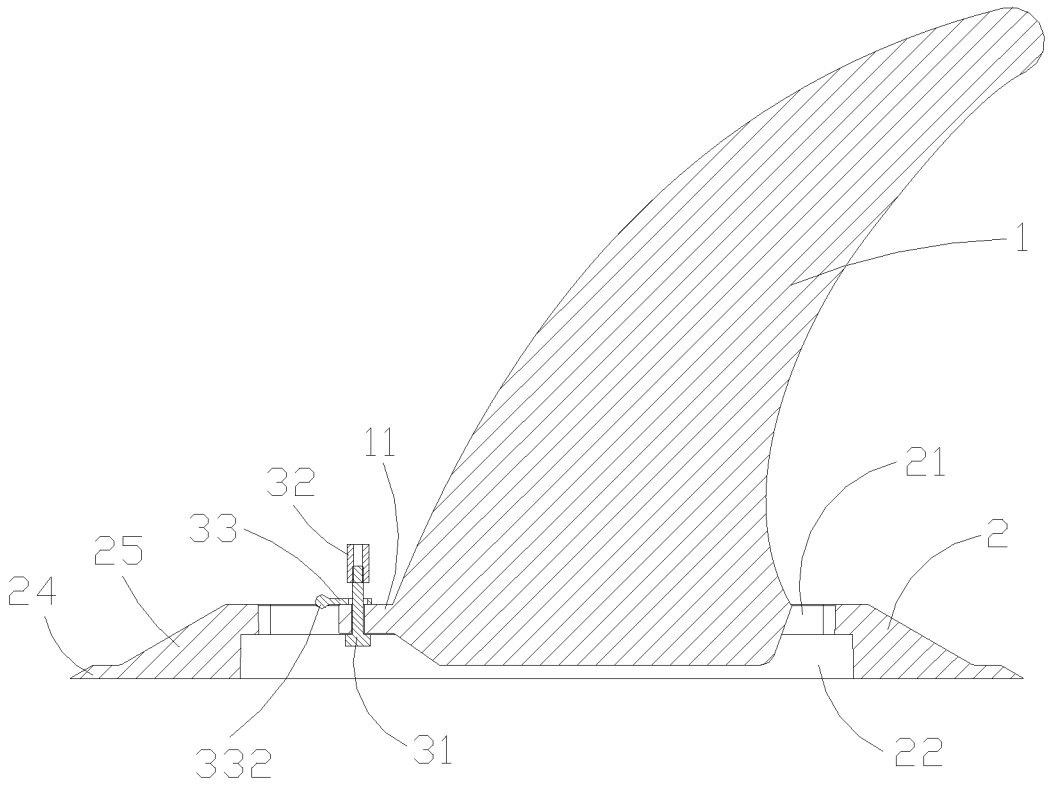
FIG. 5 is a sectional view (not including a bottom cover) in a A-A direction of FIG. 3.

As shown in FIG. 1, FIG. 2, FIG. 4 and FIG. 5, the disclosure discloses a stern rudder fixing structure, which is configured to fixedly connect a stern rudder body to a stern rudder base, including a T-shaped bolt 31, a nut 32 and a rotary rod 33 for driving the T-shaped bolt to rotate, where the stern rudder body 1 is detachably (may be a splicing mode) connected to the stern rudder base 2; a head of the T-shaped bolt faces downwards and tightly clings to the stern rudder 2; a rod part of the T-shaped bolt 31 penetrates through a through hole in the stern rudder body 1 from bottom to top and then is in threaded connection to the nut.

Preferably, the rod part of the T-shaped bolt 31 is cut into two opposite planes which are connected to a threaded part of the rod body; a waist-shaped hole matched with the T-shaped bolt 31 is formed in the rotary rod 33; and the rod part of the T-shaped bolt 31 is inserted into the waist-shaped hole of the rotary rod 33.

Preferably, a stop block or a stop pin 332 is arranged at one end, away from the waist-shaped hole, of the rotary rod; and the stop block or the stop pin 332 is blocked into a slot or a hole of the stern rudder base 2 when the rotary rod 33 drives the T-shaped bolt 31 to rotate to a set angle. The T-shaped bolt 31 matched with the waist-shaped hole can rotate through the stop block or the stop pin, so that the nut 32 is conveniently screwed up.

Figure 3:
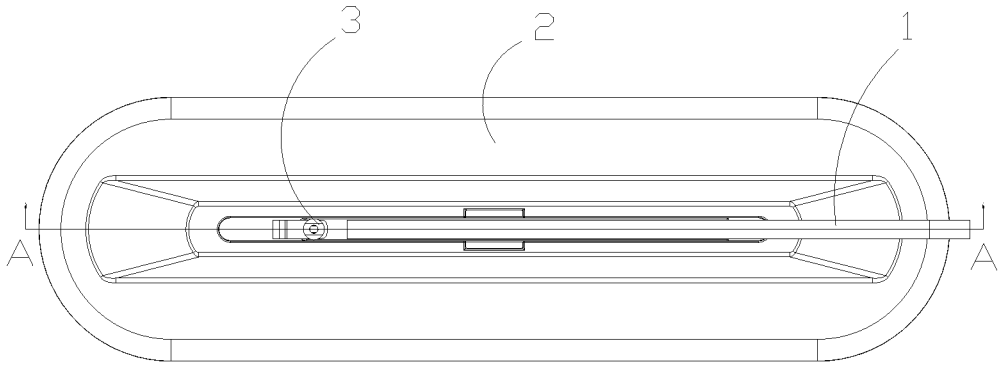
FIG. 3 is a top view of a stern rudder disclosed in embodiments of the disclosure.
Figure 6:
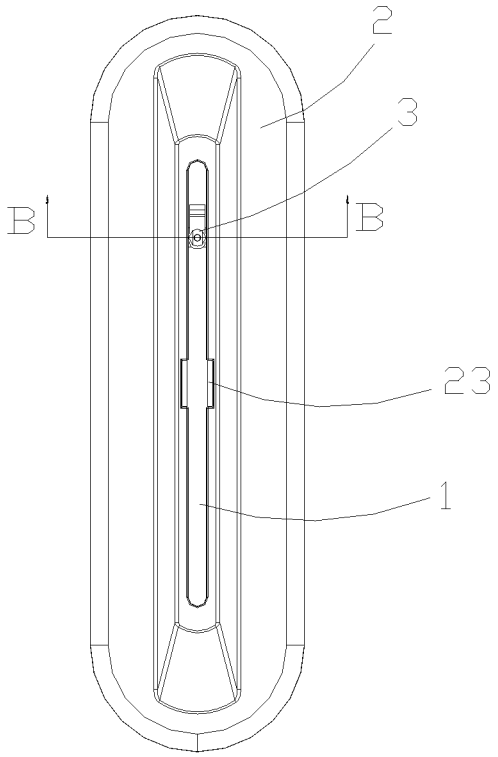
FIG. 6 is a top view of a stern rudder disclosed in embodiments of the disclosure.
Figure 7:
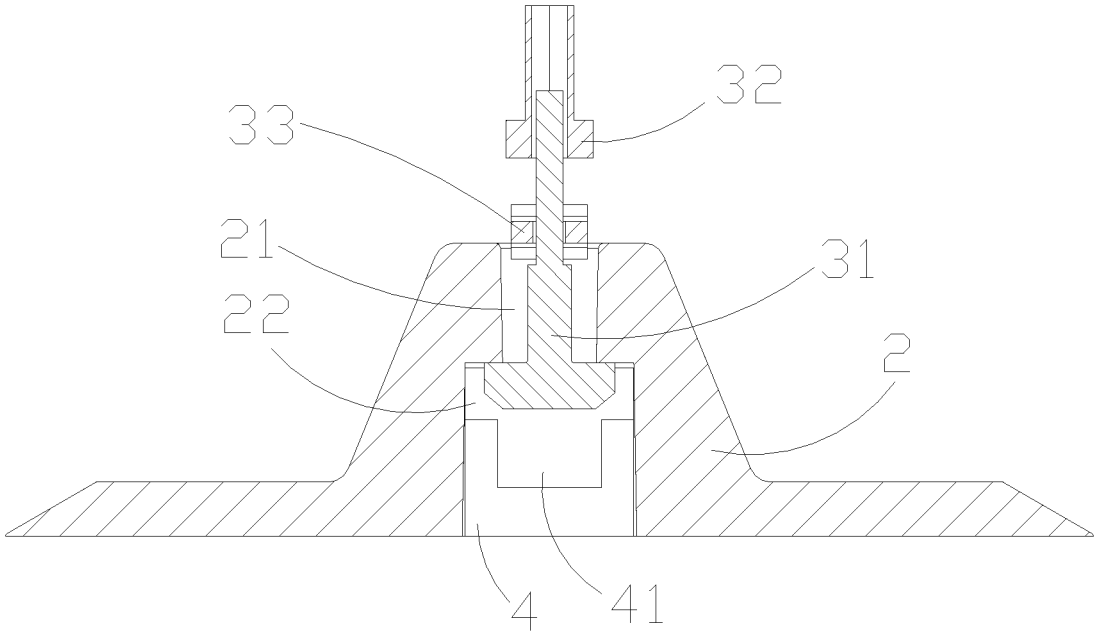
FIG. 7 is a sectional view in a B-B direction of FIG. 6.
Figure 8:
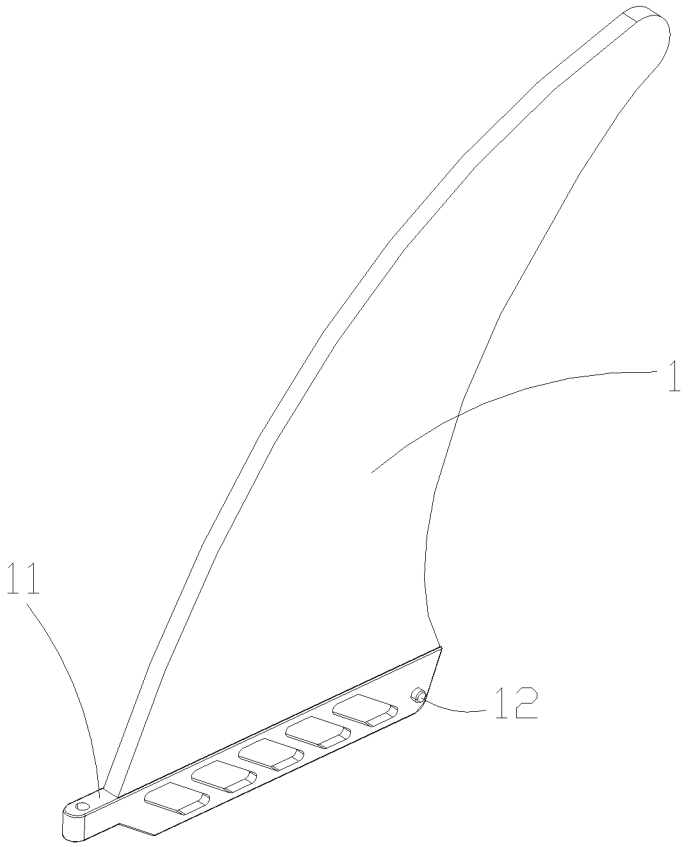
FIG. 8 is a structural schematic diagram of a stern rudder body disclosed in embodiments of the disclosure.

As shown in FIG. 1 to FIG. 8, the disclosure discloses a stern rudder adopting the stern rudder fixing structure, including a stern rudder body 1 and a stern rudder base 2, where a first insertion hole 21 and a second insertion hole 22 are sequentially formed in the stern rudder base 2 from top to bottom; the first insertion hole 21 communicates with the second insertion hole 22; the peripheral dimension of the second insertion hole 22 is greater than that of the first insertion hole 21; the first insertion hole 21 and the second insertion hole 22 integrally form an inverted-step-shaped hole; one end (specifically one end of the bottom of the stern rudder body 1) of the stern rudder body 1 is outwards extended with a mounting burgled part 11; the stern rudder body 1 is inserted into the first insertion hole 21 and the second insertion hole 22; the mounting bulge part 11 is positioned in the first insertion hole 21; the stern rudder body 1 is fixedly arranged in the stern rudder base 2 through the fixing structure 3;

The fixing structure 3 includes a T-shaped bolt 31, a nut 32 and a rotary rod 33 for driving the T-shaped bolt 31 to rotate, where a length of the head of the T-shaped bolt 31 is greater than a width of the first insertion hole 21, a width of the head of the T-shaped bolt 31 is smaller than a width of the first insertion hole 21, the rotary rod 33 is positioned above the mounting bulge part 11; when the head of the T-shaped bolt 31 rotates until a length direction thereof is parallel to a length direction of the first insertion hole, the T-shaped bolt 31 can enter the second insertion hole 22 from the first insertion hole 21 in a head-down mode; when the stern rudder body 1 is fixedly connected to the stern rudder base 2 through the fixing structure, the head of the T-shaped bolt 31 is positioned in the second insertion hole 22, and the length direction of the head of the T-shaped bolt 31 is perpendicular to the length direction of the first insertion hole 21; and the rod part of the T-shaped bolt 31 passes through the mounting burgled part 11 from bottom to top and is connected to the rotary rod 33 so as to be in a threaded connection state with the nut 32.

The rod part of the T-shaped bolt 31 is cut into two opposite planes which are connected to a threaded part of the rod body; a waist-shaped hole 331 matched with the rod part is formed in the rotary rod 33; and the rod part of the T-shaped bolt 31 is inserted into the waist-shaped hole 331 of the rotary rod 33. The waist-shaped hole 331 is matched with two planes of the T-shaped bolt 31.

A stop pin 332 is arranged at one end, away from the waist-shaped hole 331, of the rotary rod 33; when the stern rudder body 1 is in a locking state, the axis of the stop pin 332 is perpendicular to the length direction of the first insertion hole 21; and the two end parts of the stop pin 332 are locally blocked into the first insertion hole 21.

An opening 23 which is wider than the first insertion hole 21 and narrower than or as wide as the second insertion hole 22 is formed in a middle area of the first insertion hole 21; the opening 23 communicates with the second insertion hole 22; a limiting column 12 is fixedly arranged on each of two side surfaces at one end, away from the mounting bulged part 11, of the stern rudder body 1 separately; and when the stern rudder body 1 is inserted into the stern rudder bas 2*e*, the limiting columns 12 slide into the second insertion hole 22 from the opening 23.

The stern rudder further includes a bottom sealing cover 4 which is used for sealing the bottom of the second insertion hole 22, where an insertion slot 41 is formed in the bottom sealing cover 4; and the bottom of the stern rudder body 1 is inserted into the insertion slot 4 matched with the stern rudder body 1.

The stern rudder base 2 includes a base plate 24, and a bulged part 25 upwards bulged from the upper surface of the base plate 24; and the first insertion hole 21 is formed in the bulged part 25, and the second insertion hole 22 is formed in the bulged part 25 and the base plate 24.

The embodiments of the disclosure further disclose a paddle board, including the stern rudder and the paddle board body, where the stern rudder base 2 is fixedly arranged on the paddle board body. The bottom end surface of the stern rudder base 2 is adhered onto the paddle board body through an adhesive.

An assembly process of the stern rudder body 1 and the stern rudder base 2 disclosed in the embodiments of the disclosure is as follows:

Firstly, the fixing structure 3 is mounted on the mounting bulged part 11 of the stern rudder body 1 in a loose mode, i.e., the T-shaped bolt 31 passes through the mounting bulged part 11 and the rotary rod 33 from bottom to top, and the nut 32 is in threaded connection to, but is not screwed up with the rod part of the T-shaped bolt 31.

Secondly, when the stern rudder body 1 with the fixing structure 3 is inserted into the stern rudder base 2, the limiting columns 12 slide into the second insertion hole 22 from the opening 23, and the rear half section of the stern rudder body 1 is pushed to slide to the tail part of the second insertion hole 22, and the limiting columns 12 are also positioned at the tail part of the second insertion hole 22.

Thirdly, the rotary rod 33 rotates to drive the T-shaped bolt 31 to rotate, so that the length direction of the head of the T-shaped bolt 31 is parallel to the length direction of the first insertion hole 21; and the width of the head of the T-shaped bolt 31 is smaller than that of the first insertion hole 21, the T-shaped bolt 31 can be put into the second insertion hole 22.

Finally, the rotary rod 33 rotates to drive the T-shaped bolt 31 to rotate until the length direction of the head of the T-shaped bolt 31 is perpendicular to the length direction of the first insertion hole 21, and then the locking of the fixing structure 3 is realized by screwing up the nut 32; and the head of the T-shaped bolt 31 tightly clings to the top wall of the second insertion hole.

Various modifications to the embodiments will be obvious to a person skilled in the art, and the general principle defined herein can be implemented in other embodiments without departing from the spirit or scope of the disclosure. Therefore, the disclosure will not be limited to the embodiments herein, but should conform to the widest scope consistent with the principles and novel features disclosed herein.

What is claimed is:

1. A stern rudder fixing structure, which is configured to fixedly connect a stern rudder body to a stern rudder base, comprising a T-shaped bolt, a nut and a rotary rod for driving the T-shaped bolt to rotate, wherein the stern rudder body is detachably connected to the stern rudder base; a head of the T-shaped bolt faces downwards and tightly clings to the stern rudder; a rod part of the T-shaped bolt penetrates through a through hole in the stern rudder body from bottom to top and then is in threaded connection to the nut.

2. The stern rudder fixing structure of claim 1, wherein the rod part of the T-shaped bolt is cut into two opposite planes which are connected to a threaded part of the rod body; a waist-shaped hole Latched with the rod part is formed in the rotary rod; and the rod part of the T-shaped bolt is inserted into the waist-shaped hole of the rotary rod.

3. The stern rudder fixing structure of claim 2, wherein a stop block or a stop pin is arranged at one end, away from the waist-shaped hole, of the rotary rod; and the stop block or the stop pin is blocked into a slot or a hole of the stem rudder base when the rotary rod drives the T-shaped bolt to rotate to a set angle.

4. A stern rudder, comprising a stem rudder body and a stern rudder base, wherein a first insertion hole and a second insertion hole are sequentially formed in the stern rudder base from top to bottom;

the first insertion hole communicates with the second insertion hole;

the first insertion hole and the second insertion hole integrally form an inverted-step-shaped hole;

one end of the stern rudder body is outwards extended with a mounting bulge part;

the stern rudder body is inserted into the first insertion hole and the second insertion hole;

the mounting bulge part is positioned in the first insertion hole;

the stem rudder body is fixedly arranged in the stern rudder base through a fixing structure;

the fixing structure comprises a T-shaped bolt, a nut and a rotary rod for driving the T-shaped bolt tri rotate, wherein a length of the head of the T-shaped bolt is greater than a width of the first insertion hole, a width of the head of the T-shaped bolt is smaller than a width of the first insertion hole, the rotary rod is positioned above the mounting bulge part;

when the head of the T-shaped bolt rotates until a length direction thereof is parallel to a length direction of the first insertion hole, the T-shaped bolt can enter the second insertion hole from the first insertion hole in a head-down mode; when the stern rudder body is fixedly connected to the stern rudder base through the fixing, structure, the head of the T-shaped bolt is positioned in the second insertion hole, and the length direction of the head of the T-shaped bolt is perpendicular to the length direction of the first insertion hole; and the rod part of the T-shaped bolt passes through the mounting bulge part from bottom to top and is connected to the rotary rod so as to be in a threaded connection state with the nut.

5. The stern rudder of claim 4, wherein the rod part of the T-shaped bolt is cut into two opposite planes which are connected to a threaded part of the rod body; a waist-shaped hole matched with the rod part is formed in the rotary rod; and the rod part of the T-shaped bolt is inserted into the waist-shaped hole of the rotary rod.

6. The stem rudder of claim 5, wherein a stop pin is arranged at one end, away from the waist-shaped hole, of the rotary rod; when the stern rudder body is in a locking state, the axis of the stop pin is perpendicular to the length direction of the first insertion hole; and the two end parts of the stop pin are locally blocked into the first insertion hole.

7. The stern rudder of claim 4, wherein an opening which is wider than the first insertion hole and narrower than or as wide as the first insertion hole is formed in a middle area of the first insertion hole; the opening communicates with the second insertion hole; a limiting column is fixedly arranged on each of two side surfaces at one end, away from the mounting bulge part, of the stern rudder body separately; and when the stern rudder body is inserted into the stern rudder base, the limiting columns slide into the second insertion hole from the opening.

8. The stern rudder of claim 4, further comprising a bottom sealing cover which is used for sealing the bottom of the second insertion hole, wherein an insertion slot is formed in the bottom sealing cover; and the bottom of the stern rudder is inserted into the insertion slot matched with the stern rudder.

9. The stern rudder of claim 4, wherein the stern rudder base comprises a base plate, and a bulge part upwards bulged from the upper surface of the base plate; and the first insertion hole is formed in the bulge part, and the second insertion hole is formed in the bulge part and the base plate.

10. A paddle board, comprising the stern rudder of claim 4 and a paddle board body, wherein the stern rudder base is fixedly arranged on the paddle board body; and preferably, the bottom end surface of the stern rudder base is adhered on the paddle board body through an adhesive.

* * * * *